US007401411B2

(12) United States Patent
White

(10) Patent No.: US 7,401,411 B2
(45) Date of Patent: Jul. 22, 2008

(54) ARCHERY ALIGNMENT DEVICE AND METHOD OF USE

(76) Inventor: Adam White, P.O. Box 692, Prestonsburg, KY (US) 41653

( * ) Notice: Subject to any disclaimer, the term of this patent is extended or adjusted under 35 U.S.C. 154(b) by 0 days.

(21) Appl. No.: 11/411,724

(22) Filed: Apr. 26, 2006

(65) Prior Publication Data

US 2007/0251109 A1 Nov. 1, 2007

(51) Int. Cl.
*F41G 1/467* (2006.01)
*F41G 1/54* (2006.01)

(52) U.S. Cl. ..... 33/265; 124/86

(58) Field of Classification Search ..... 33/265, 33/494, 506, 613, 645; 124/1, 86, 90
See application file for complete search history.

(56) References Cited

U.S. PATENT DOCUMENTS

| | | | | |
|---|---|---|---|---|
| 4,542,591 | A * | 9/1985 | Montgomery | 33/265 |
| 5,048,193 | A * | 9/1991 | Hacquet | 33/265 |
| 5,201,304 | A * | 4/1993 | Rezmer | 124/87 |
| 6,796,037 | B1 * | 9/2004 | Geffers et al. | 33/265 |
| 6,813,841 | B1 * | 11/2004 | Ramsey | 33/494 |
| 2003/0177651 | A1 * | 9/2003 | Stone | 33/265 |
| 2004/0205971 | A1 * | 10/2004 | Terry et al. | 33/265 |
| 2005/0120569 | A1 * | 6/2005 | Butler et al. | 33/203 |
| 2005/0150119 | A1 * | 7/2005 | Ellig et al. | 33/265 |

* cited by examiner

*Primary Examiner*—G. Bradley Bennett
(74) *Attorney, Agent, or Firm*—Stockwell & Smedley PSC

(57) ABSTRACT

An archery bow alignment mechanism is disclosed.

11 Claims, 10 Drawing Sheets

ARCHERY ALIGNMENT DEVICE AND METHOD OF USE

FIELD OF THE INVENTION

The present invention relates to a mechanism for improving the alignment of an archery bow.

BACKGROUND OF THE INVENTION

Even an expert archer can sometimes introduce twist, skew, and camber into their sighting when they pull the bow string. Consequently, a method and apparatus for improving archery alignment is desired.

SUMMARY OF THE INVENTION

It is an object of the present invention to provide an apparatus for improving accuracy when using an archery bow, including a bracket, attachable to the body of an archery bow at a user-configurable location; a plurality of alignment pins located within said bracket at a user-configurable depth and height; and an alignment gauge, for positioning the depth of said pins in accordance with an offset of a string of the archery bow.

These and other objects of the invention will become readily apparent as the following description is read in conjunction with the accompanying drawings.

DETAILED DESCRIPTION OF THE PREFERRED EMBODIMENTS

Before explaining the disclosed embodiment of the present invention in detail it is to be understood that the invention is not limited in its application to the details of the particular arrangement shown, since the invention is capable of other embodiments. Also, the terminology used herein is for the purpose of description and not of limitation.

The present invention utilizes both alignment pins and an alignment gauge and is indented to assist an archer in shooting a bow effectively. The present invention achieves this by assisting an archer in avoiding skew or twist into their pull-back and release motion while operating the bow.

Figure 1:
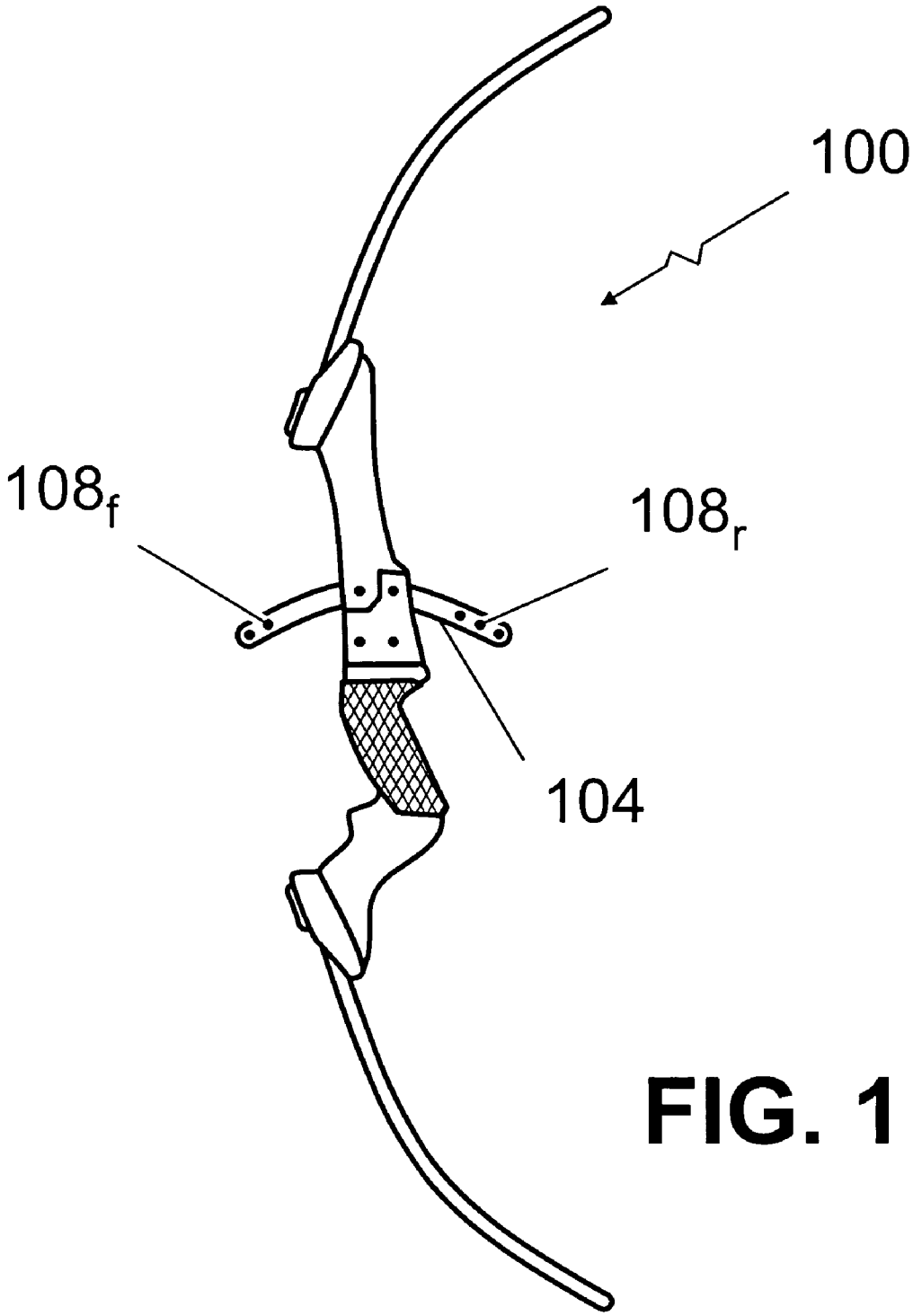
FIG. 1 shows a front view of the present invention mounted on an archery bow.

FIG. 1 shows a side view of the bracket 104 while attached to a bow. As shown in FIG. 1, to use the present invention, it is necessary to attach the bracket 104 containing the forward and rear alignment pins $\mathbf{108}_f$ and $\mathbf{108}_r$ to the center of the bow 100. Most bows come equipped with threaded insertion points for attaching an arrowrest. The bracket 104 makes use of these standard insertion points, so that the present invention requires no alteration to the bow.

The bracket 104 is thus mounted between the arrowrest and the body of the bow 100. As shown in FIGS. 8A-8D, the brackets 104 have a variety of holes and apertures for accommodating the differing surfaces and insertion points of a variety of bows.

After attaching the bracket 104, it is necessary to insert the forward and rear alignment pins $\mathbf{108}_f$ and $\mathbf{108}_r$ at a specific depth into the bracket 104. This depth corresponds to the offset of the bowstring 112, as shown in FIGS. 2A-2C and 4. Once the alignment pins $\mathbf{108}_f$, $\mathbf{108}_r$ are installed, it is necessary to check the protrusion or depth of those pins by using a gauge (not shown in FIGS. 1-4). Only after this process has been completed is it possible to take advantage of the improved accuracy of the present invention.

With every different bow, the strings all have an offset from the body of a bow, although the size of that offset varies. It is thus necessary for an archer to compensate for these offsets, and to be sure their shooting window is true and square. Using the present invention, an archer can make modifications to any bow that may occur from her twisting or torsion during pulling of the bowstring. The present invention thus assists the archer in providing feedback in keep the bow straight and properly aligned, and thus helps improve shooting accuracy.

Not all bows are the same or have the same characteristics. If the bow string has an offset, it can be helpful for to the archer to allow for this offset when aiming their bow. To accomplish this, the archer views the sight lines along the alignment pins $\mathbf{108}_f$ and $\mathbf{108}_r$, which must protrude exactly the same distance from the bracket 104. However, to be sure the alignment pins $\mathbf{108}f$ and $\mathbf{108}_r$ are indeed both installed to the correct depth, it is necessary to use an alignment pin gauge.

The present invention comes with two alignment pin gauges, a small and a large. The smaller gauge 500 (FIG. 5) measures the protrusion of the alignment pins $\mathbf{108}_f$ and $\mathbf{108}_r$ as they are attached to the bracket 104. Although the smaller gauge 500 is about the size of a typical ruler, a ruler would not be satisfactory to perform the measurements required. This is because the measurement lines on a ruler are transverse to the body of a bow. Instead, the smaller gauge 500 has lines that run its entire length, and are parallel with the body of a bow.

The larger gauge 600, 700 (FIGS. 6, 7) attaches not only to the alignment pins $\mathbf{108}_f$ and $\mathbf{108}_r$, but also touches the bowstring 112 either while pulled back, or not. To use the larger gauge 600, 700, the archer must be assisted by another person. While the bow string 112 is pulled back by the archer, a second person attaches the larger gauge to the alignment pins $\mathbf{108}_f$ and $\mathbf{108}_r$ but also the bow string 112. The second person positioning the sliding block 604 to flatly abut against the body of the bow near the bow string while pulled back, and then determines the offset of the bowstring 112 while at the pulled back stage. The user can then adjust the depth of the alignment pins $\mathbf{108}_f$ and $\mathbf{108}_r$ to match this offset.

It is possible, however, to successfully operate the present invention without using the larger alignment gauges 600, 700. These act merely as a check, or means of ensuring the accuracy of the shorter alignment gauge 500.

Figure 2A:
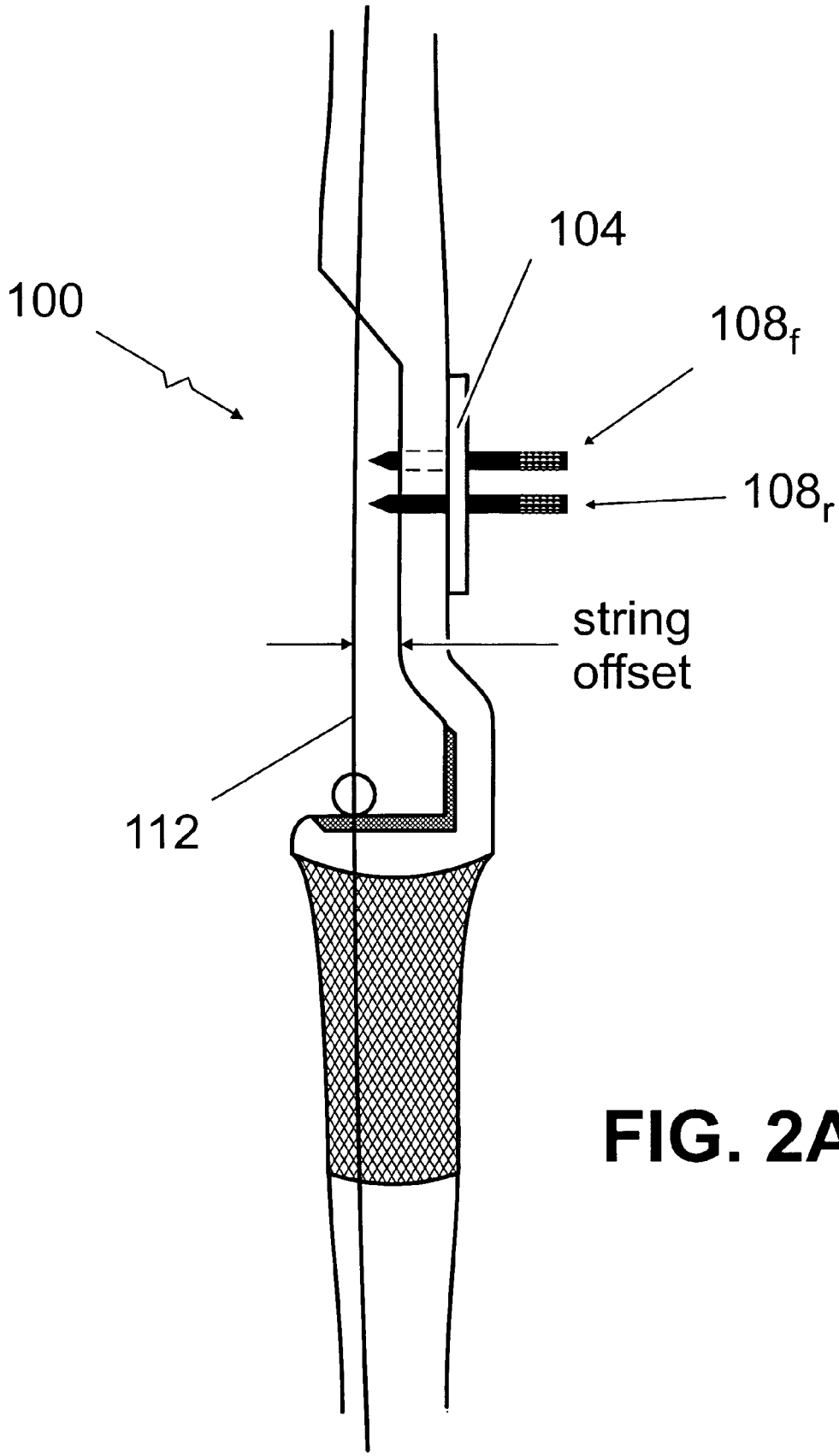
FIGS. 2A, 2B, and 2C show side views of the embodiment of FIG. 1.
Figure 2B:
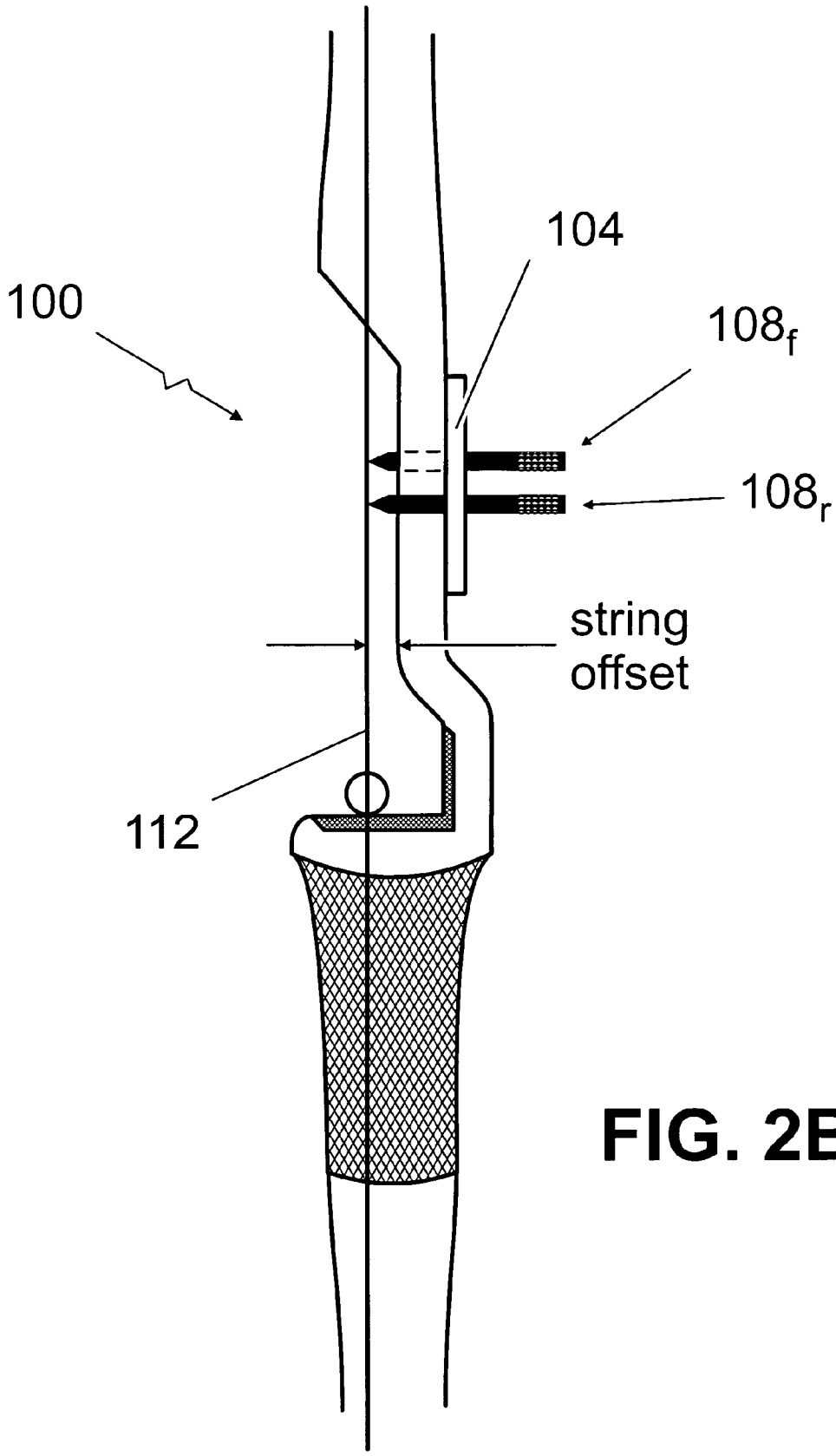
Figure 2C:
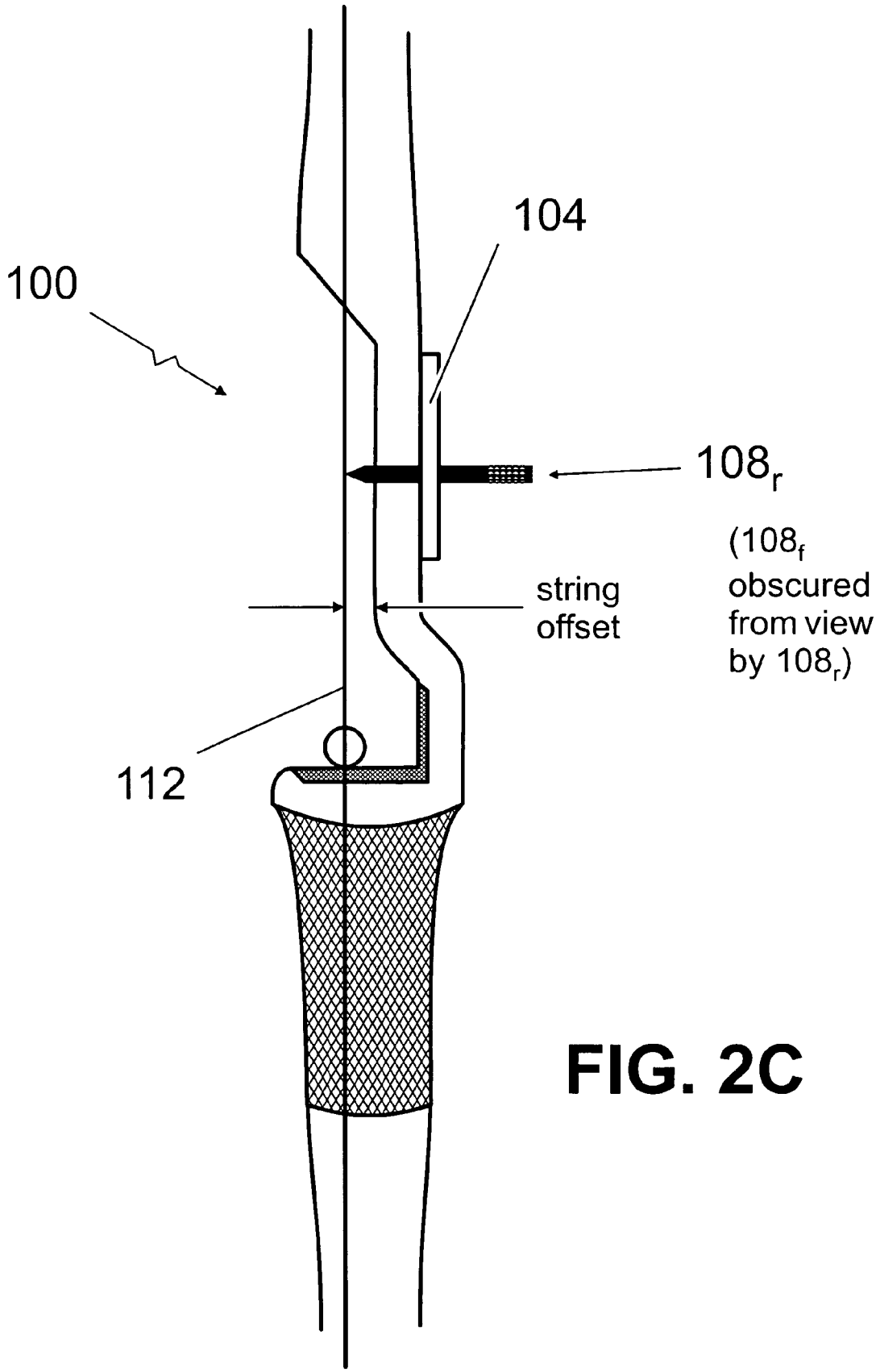

FIGS. 2A-2C show a front view of the bracket 104 and bow of FIG. 1. FIGS. 2A-2C assume that the pins $\mathbf{108}_f$ and $\mathbf{108}_r$ within the bow have been properly calibrated.

FIGS. 2A-2C show an example of a bow from the point of view of an archer, with bowstring 112 already pulled back and the archer attempting to sight on a target. In FIG. 2A, the bow is mis-aligned both from a right-left standpoint, but also from an up-down standpoint. The result will be an arrow that misses the target. FIGS. 2A and 2B also show alignment problems that would be hard for an archer to notice unless they have the present invention installed.

The right-left error of FIG. 2A will be addressed first. Once the archer is aware of having introduced error or skew into their pullback of the bowstring 112, that archer can re-align her bow to center their sighting. An example of this is shown in FIG. 2B, which shows how the alignment pins $\mathbf{108}_f$ and $\mathbf{108}_r$ are perfectly flush with, but do not extend past, the bowstring 112.

However, FIG. 2B also shows that the archer still has an up-down problem with their sighting. To address this, the archer can adjust her bow until the forward and rear alignment pins $\mathbf{108}_f$ and $\mathbf{108}_r$ are properly aligned. However, using the up-down adjustment of the present invention is secondary, as many archers vary the up-down positioning of their bow in order to allow for gravity and distance of the shot. In such a case, its possible that the archer will not want to evenly align the alignment pins $\mathbf{108}_f$ and $\mathbf{108}_r$, but instead may wish to have some separation.

Figure 3:
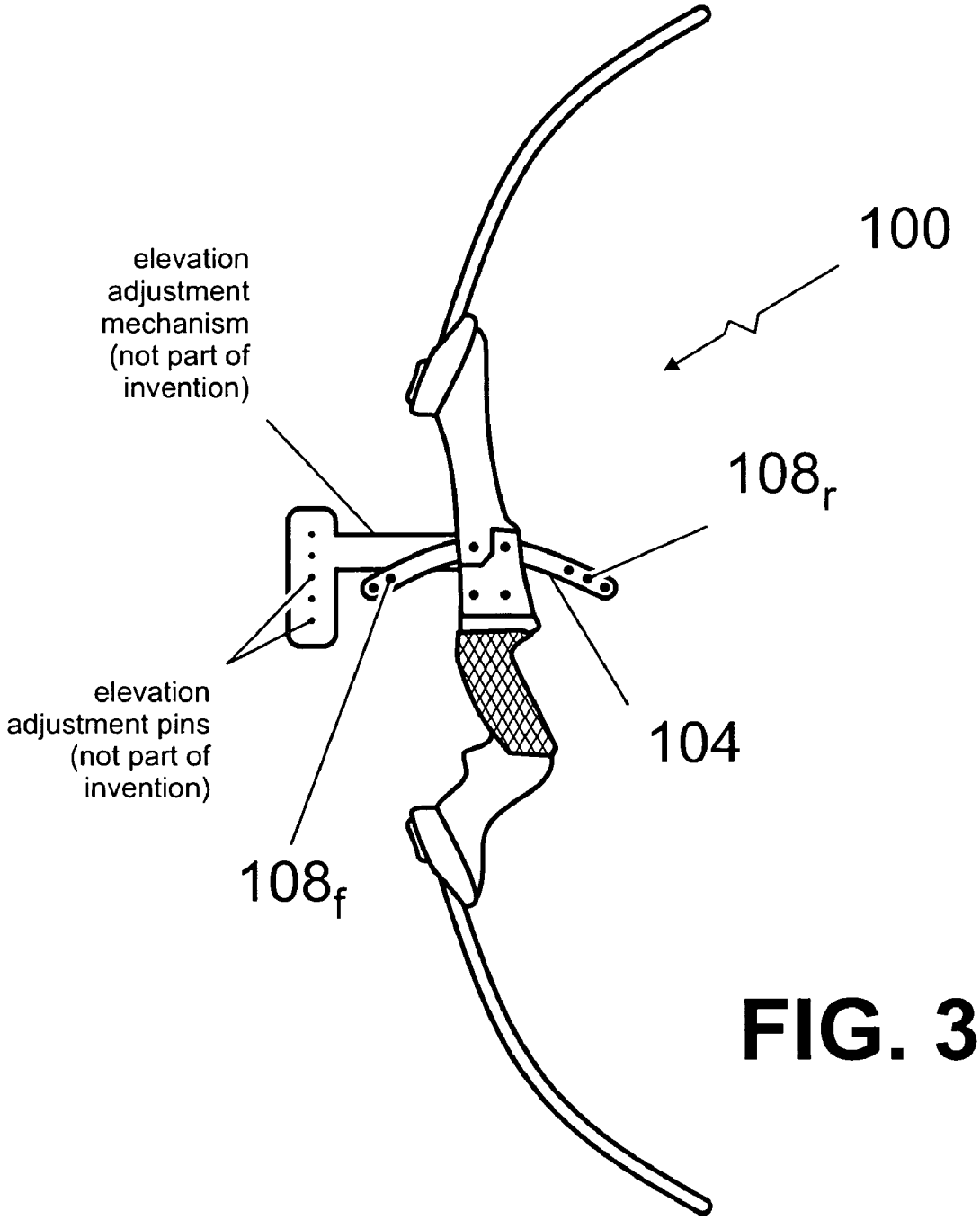
FIGS. 3 and 4 show the embodiment of FIGS. 1 and 2 with an elevation adjustment mechanism mounted nearby.
Figure 4:
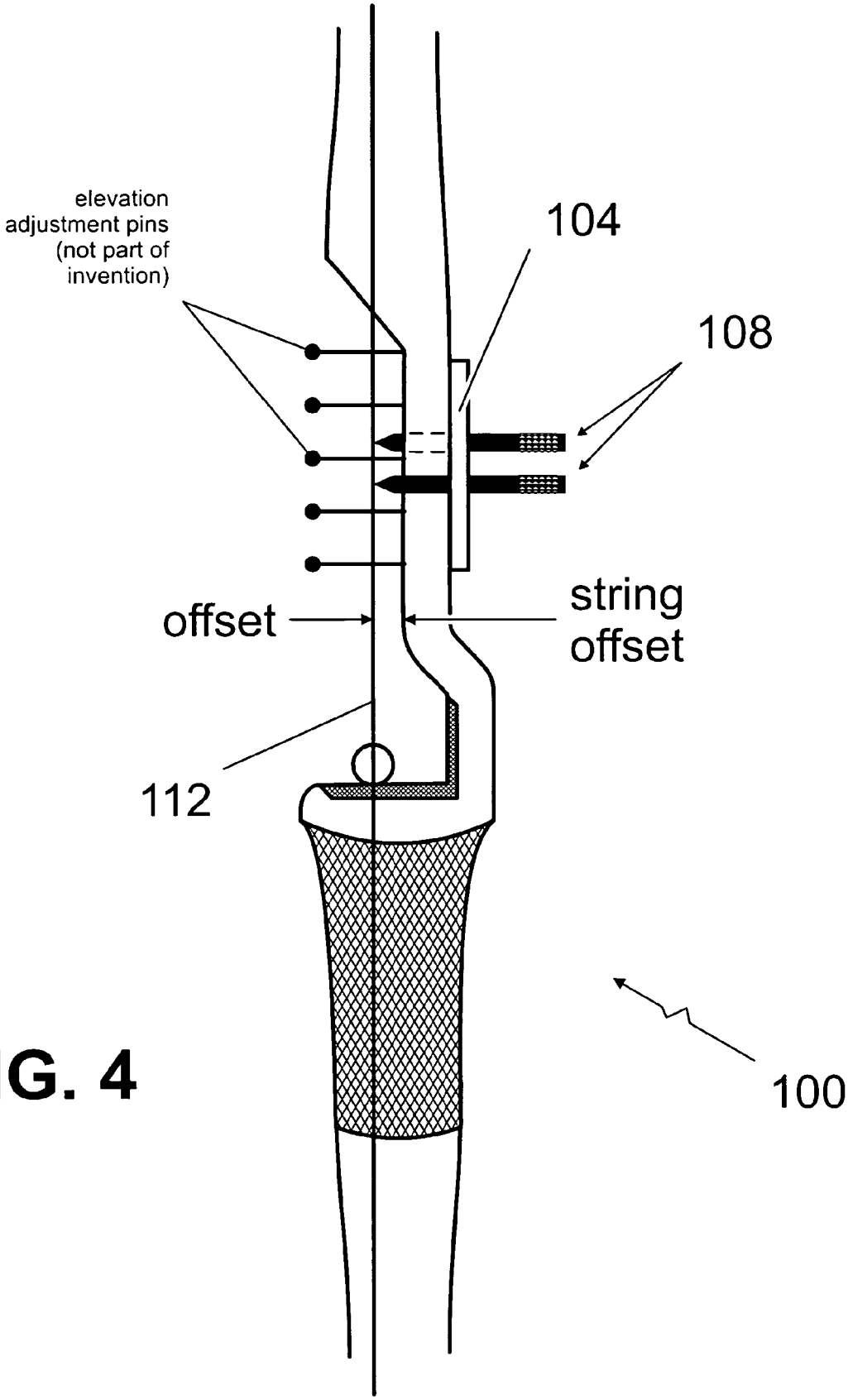

To further illustrate this, FIG. 3 shows a front view of a first embodiment of the present invention, but also with an elevation adjustment bracket and pins attached. The present invention works in conjunction with and does not conflict with elevation adjustment mechanisms. An archer who is familiar with elevation adjustment pins will likely have less difficulty understanding the value and utility of the present invention. However, the present invention is useful whether elevation adjustment mechanisms are used or not. Thus, FIG. 4 shows how the sight-lines of the elevation adjustment mechanisms do not interfere with or conflict with the alignment pins $\mathbf{108}_f$ and $\mathbf{108}_r$.

Figure 5:
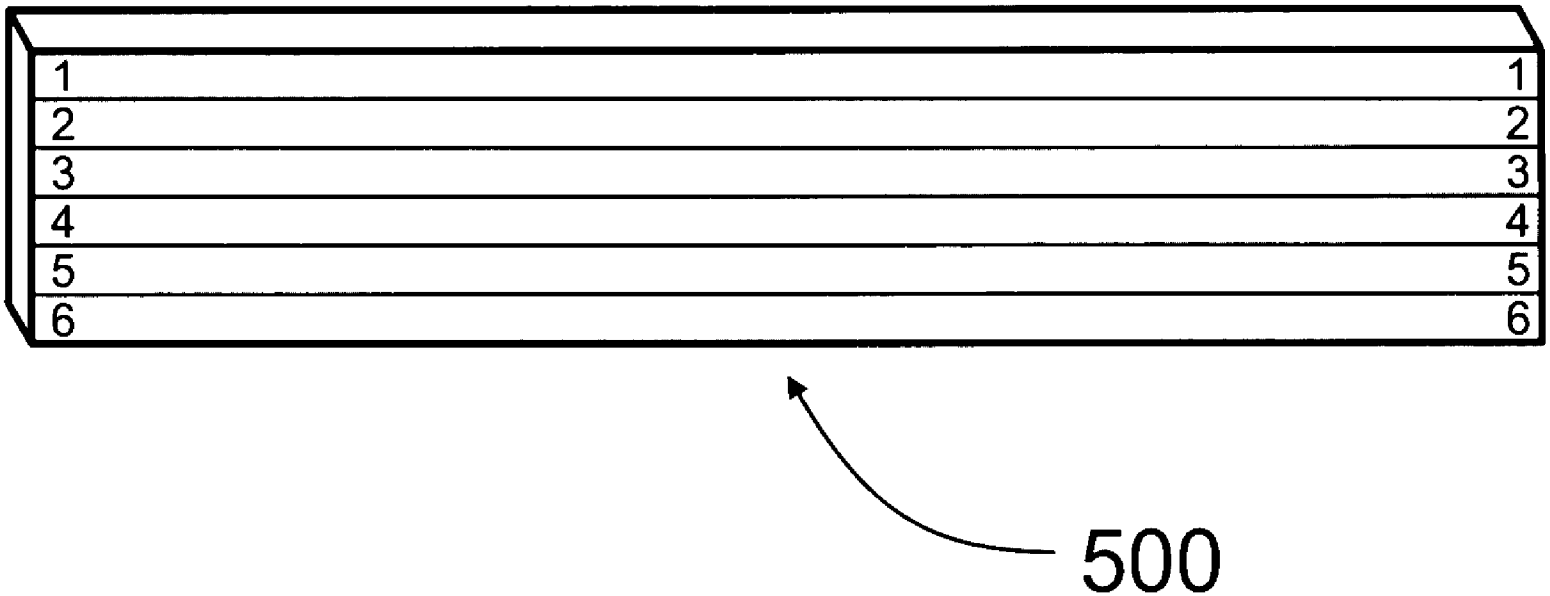
FIG. 5 shows an embodiment of a short alignment gauge of the present invention.

FIG. 5 shows a smaller alignment gauge 500 not attached to the bracket 104. The numbers on the surface of the gauge 500 assist the archer in determining how deep to place the pins $\mathbf{108}_f$ and $\mathbf{108}_r$ on the bracket 104. The pins $\mathbf{108}_f$ and $\mathbf{108}_r$ are laterally inserted into the bracket 104, at a depth intended to fit flush with the offset of the bowstring 112, as depicted in FIGS. 2 and 4. Depending on where the bracket 104 is located upon the bow 100, it is necessary to push or pull the pins $\mathbf{108}_f$ and $\mathbf{108}_r$ to extrude at various distances from the bracket 104. As stated, it is desired to match the pins $\mathbf{108}_f$ and $\mathbf{108}_r$ with the offset of the bow string, as well as with each other. This is accomplished by using the numbers on the side of the gauge 500, 600, 700.

Figure 6:
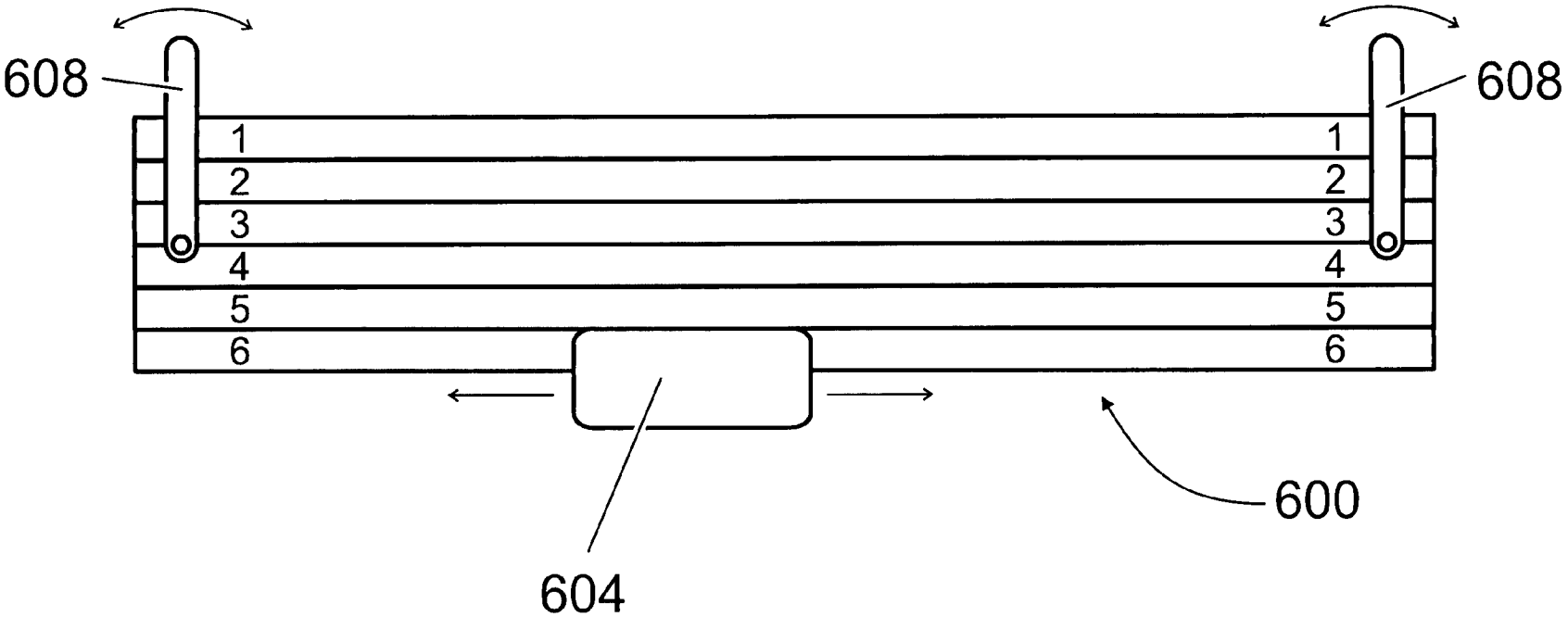
FIG. 6 shows a first embodiment of a long alignment gauge of the present invention.

FIG. 6 shows a first embodiment of a longer gauge 600 which requires two people to operate. To operate the alignment gauge 600 in FIG. 6, it is necessary for a first user to pull the bow back, and then have a second person attach the gauge 600 to the bow, alignment pins $\mathbf{108}_f$ and $\mathbf{108}_r$, and also the bow string 112. This is because one way to determine the actual offset of a bowstring is by measuring that offset while the string is pulled back. The sliding block 604 assists the user in determining the offset of the bowstring 112, and then adjusting the depth of the alignment pins $\mathbf{108}_f$ and $\mathbf{108}_r$ to that offset.

In FIG. 6 there are also rotating rods 608 attached to the long alignment gauge 600. These rods 608 have numbers so that a distance between the body and the offset of bowstring 112 can be visually determined and then remembered. This is because the user must set down the gauge 600 in order to then make adjustments to the pins $\mathbf{108}_f$ and $\mathbf{108}_r$. The rods 608 are also on a swivel so that they can be moved out of the way when the gauge 600 is being used for other purposes.

Figure 7:
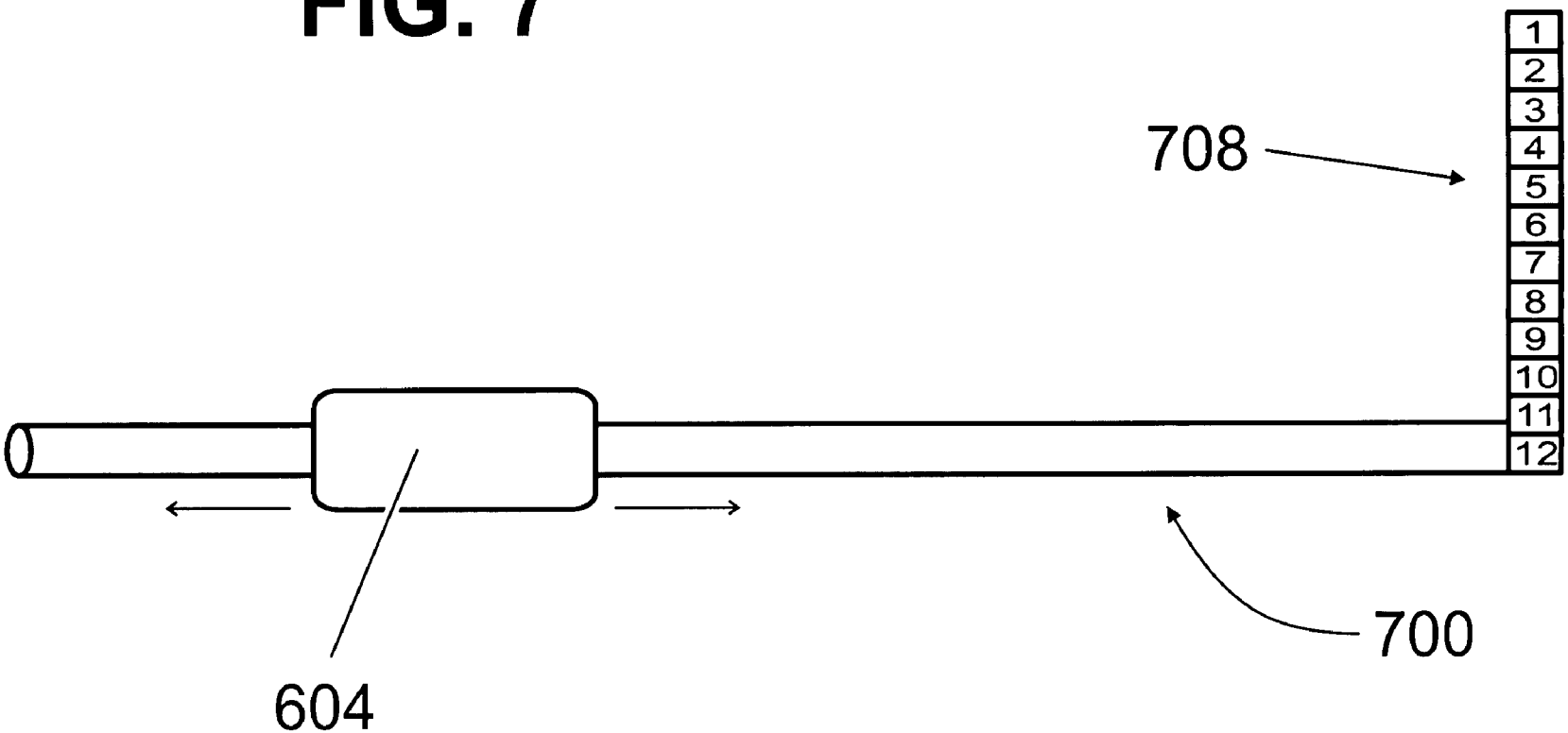
FIG. 7 shows a second embodiment of a long alignment gauge of the present invention.
Figure 8B:
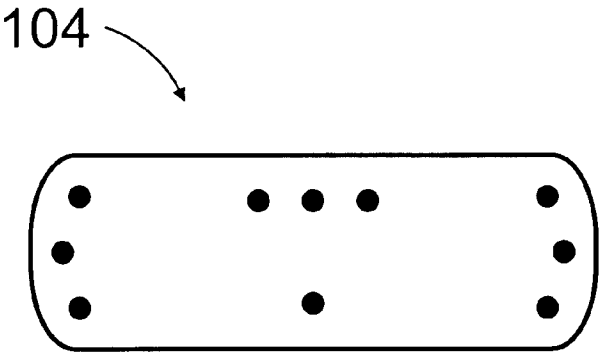
FIGS. 8A through 8D show exemplary embodiments of the bracket of FIGS. 1-4.
Figure 8D:
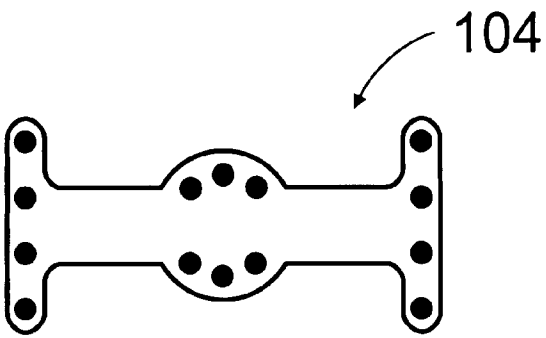
Figure 8A:
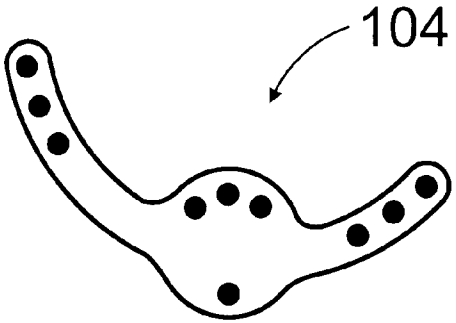
Figure 8C:
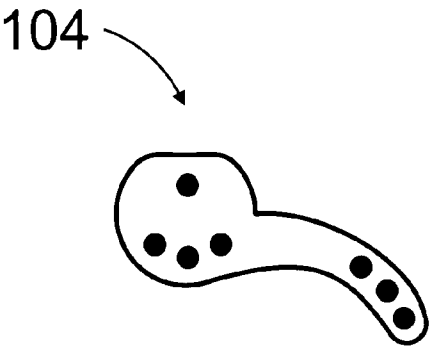

FIG. 7 shows an alternate embodiment of the long alignment gauge 700. This embodiment also has a sliding block 604, as well as a rounded dowel-like body, but uses only a single rotating rod 708.

FIGS. 8A-8D shows a variety of different types of brackets 104 that hold and support alignment pins. FIGS. 8A-8D shows four different suggested embodiments of the bracket 104 of the present invention. However, the suggestions in FIG. 8A-8D are for exemplary purposes only, so that the present invention should not be considered as limited exclusively thereto. Other types of styles and shapes are also contemplated within the scope of the invention. Separate brackets 104 are needed, due to the large variety of bows in existence. As stated, different bows each require different types of accommodations.

Where alignment pins are located within a bracket 104 is also important. The tilt and angle of the bow 100 creates the necessity of some flexibility of how a user can install the bracket 104. The important thing is the effective straight horizontal arrangement of the alignment pins $\mathbf{108}_f$ and $\mathbf{108}_r$ be achieved. How the archer achieves this straightness is left up to the installer of the bracket 104. Thus, that explains the variety of possible holes in the brackets of FIGS. 8A-8D. With a variety of possible holes, both for mounting as well as for pins, the installer is not constrained by the specific bracket 104, and can achieve an effective horizontal alignment.

The archer can modify how he is holding and pulling the bow while sighting along the alignment pins $\mathbf{108}_f$ and $\mathbf{108}_r$. The archer can turn the bow handle to be in more true and accurate alignment, so there is no skew, or twist, or camber in the way they are holding the bow.

Even experienced archers may hold a bow in a different way each time they shoot. Without the alignment pins of the present invention, even an experienced archer may not notice that they are introducing unwanted skew, twist, or camber into the way they hold the bow.

The alignment gauges, both smaller 500 and larger 600, 700, cannot be used on a bow that is not equipped with the brackets 104 of the present invention. This is because no pins $\mathbf{108}_f$ and $\mathbf{108}_r$ would be available to give an indication of the skew or twist.

One way in determining the inaccuracy of to use of the bow is to measure the alignment while the bow is being held but the string is not being pulled back. Afterwards, a user can measure the alignment while the bow string is pulled back. This difference will help show the archers inaccuracies in their shooting forms that they introduce themselves.

The various aspects of the present invention has been described in detail with particular reference to preferred embodiments thereof, but it will be understood that variations and modifications can be effected within the spirit and scope of the invention as described herein. It is anticipated that various changes may be made in the arrangement and operation of the system of the present invention without departing from the spirit and scope of the invention, as defined by the following claims.

What is claimed is:

1. An apparatus for improving accuracy when using an archery bow, comprising:

a bracket, attachable to the body of an archery bow at a user-configurable location;

a plurality of alignment pins located within said bracket at a user-configurable depth and height; and an alignment gauge, for positioning the depth of said pins in accordance with an offset of a string of the archery bow.

2. The apparatus of claim 1, further comprising:

the alignment pins being positioned forward and rear of the bow.

3. The apparatus of claim 1, further comprising:

the bracket being positioned between the arrow rest and the body of the bow.

4. The apparatus of claim 1, further comprising:

the bracket having a variety of holes and apertures.

5. The apparatus of claim 2, further comprising:

the forward and rear alignment pins are inserted at a specific depth into the bracket, wherein that depth corresponds to a bowstring offset.

6. The apparatus of claim 5 further comprising:

the protrusion or depth of the alignment pins is checked by using the alignment gauge.

7. The apparatus of claim 5, further comprising:

while using the bow, an archer views a target by sighting along the forward end rear alignment pins.

8. A method for improving accuracy when using an archery bow, comprising:

mounting a bracket to the body of an archery bow;

locating a plurality of forward and rear alignment pins within said bracket at a user-configurable depth;

measuring the depth of an offset of a bowstring of the bow;

inserting forward and rear alignment pins to correspond to the offset; and sighting along the forward and rear alignment pins.

9. The method of claim 8, further comprising:

performing he sighting step in conjunction with an elevation adjustment mechanism.

10. The method of claim 8, further comprising:

adjusting the depth of the forward and rear alignment pins using numbers on a surface of an alignment gauge.

11. The method of claim 10, further comprising:

matching the depth of the forward and rear alignment pins with each other, as well as with the offset.

* * * * *